United States Patent [19]

Cordeiro et al.

[11] Patent Number: 5,040,607

[45] Date of Patent: Aug. 20, 1991

[54] PRODUCTION SYSTEM FOR SUBSEA OIL WELLS

[75] Inventors: André L. Cordeiro; Hélio L. M. Falcao, both of Rio de Janeiro; Renato S. Rodrigues, Niterói; Samir P. Awad, Rio de Janeiro, all of Brazil

[73] Assignee: Petroleo Brasileiro S.A. - PETROBRAS, Rio de Janeiro, Brazil

[21] Appl. No.: 350,671

[22] Filed: May 10, 1989

[30] Foreign Application Priority Data

Dec. 16, 1988 [BR] Brazil ..... PI 8806661

[51] Int. Cl.[5] ..... E21B 7/12; E02B 17/00

[52] U.S. Cl. ..... 166/366; 166/339; 166/345; 405/202; 405/195; 405/227

[58] Field of Search ..... 166/338, 339, 344, 345, 166/346, 347, 348, 349, 360, 365, 366, 351, 368; 403/57, 61; 405/195, 227, 228, 202

[56] References Cited

U.S. PATENT DOCUMENTS

| | | | |
|---|---|---|---|
| 4,211,281 | 7/1980 | Lawson . | |
| 4,497,592 | 2/1985 | Lawson | 405/202 |
| 4,625,806 | 12/1986 | Silcox | 166/339 |
| 4,784,527 | 11/1988 | Hunter et al. | 166/339 |
| 4,822,212 | 4/1989 | Hall et al. | 166/366 |
| 4,848,474 | 7/1989 | Parizot et al. | 166/366 |

FOREIGN PATENT DOCUMENTS

| | | | |
|---|---|---|---|
| 2003533 | 3/1979 | United Kingdom . | |
| 2046330 | 11/1980 | United Kingdom | 166/366 |

OTHER PUBLICATIONS

Offshore Feb. 1987, pp. 94, 95, 96, 98 (FIGS. 4, 5), Deepwater Production System Plays Effective Role in Subsea Reentry Operations.

*Primary Examiner*—Bruce M. Kisliuk
*Assistant Examiner*—Ezio DiSante
*Attorney, Agent, or Firm*—Sughrue, Mion, Zinn, Macpeak & Seas

[57] ABSTRACT

A subsea structure for oil well drilling, completion and production and specially designed for utilization in water depths of 1,000 m or more. The structure includes a template having radially extending structures and which extends radially from a central foundation, on top of which the template shall be set and where a central manifold for controlling the production of wells is located. Each structure arm is provided in its extremity with an opening for adaptation of a guide-base for well drilling, and one of the arms of the template (1) is intended to receive connectors (6) of export and well control lines.

2 Claims, 6 Drawing Sheets

27
29'
17'
30
28
1
18
16

PRODUCTION SYSTEM FOR SUBSEA OIL WELLS

FIELD OF THE INVENTION

This invention relates to a production system for subsea wells, the main component of which is a subsea structure, of template-manifold type, specially developed for utilization in production areas located at water depths of 1,000 m or more.

BACKGROUND OF THE INVENTION

Oil field development in deep waters (water depths in excess of 400 m) requires that the producing wells be subsea, which implies that the wellhead and the Christmas tree shall be installed at the seabottom, a little above the seabed.

For economic reasons, the usual practice for said development has been to group various wells into one single structure, which is set at the seabottom. This structure is internationally known as a template. It includes, usually, a square or rectangular structure, in which a given number of wells is provided for, which are spaced between themselves according to a pattern established by the American Petroleum Institute—API, which sets 2.28 m (7.5 ft) as the minimum distance between well centers.

In the 70's the oil industry started adopting subsea well production and wet Christmas trees were developed. In the beginning, the production from various satellite wells was collected into one central manifold, being transported to floating storage or production units, or to fixed platforms.

With the discovery of major fields in water depths in excess of 400 m (current limit for divers' assistance), the oil industry started adopting subsea completion as an economically more feasible option for production development from said fields.

As a function of the specific characteristics of the producing reservoirs, the industry initiated the establishment of new template concepts, so as to make possible the existence of various producing wells in one single area and make production collecting to one single manifold easy, which could or not be incorporated into the template. The term template manifold refers to structures in which the manifold is associated to the template.

DESCRIPTION OF THE PRIOR ART

The subsea template manifolds currently known include structures containing guide-bases, on top of which the well heads and the Christmas trees are installed, as well as the manifold which collects well production.

Having in view that the distance between wells complies with international standards and said distance is not large, in face of the dimension of the equipment to be installed, it is easy to anticipate the operational and safety difficulties which must be faced to place the wells in production condition.

From an operational point of view, it must be considered that the template structure is usually very heavy, requiring a special foundation, a piling system and rigorous levelling, to make well drilling and a perfect installation of Christmas trees possible. Most structures are provided with their own levelling system, the acceptable unevenness (in relation to the horizontal) being in the order of 1 degree.

To install those structures at the seabottom, the use of major lift units and good sea condition are required. The operational cost cf those units is rather high, and the installation operation rather time-consuming.

Another problem which usually occurs, even in those structures which are installed in an elevated position in relation to the seabottom, is the deposition of drilling cuttings around wells already completed, which may require expensive and difficult cleaning operations, particularly in case of deep-water operation.

From a safety point of view, the difficulties are still greater. The operations conducted on the template, whether drilling (the most time-consuming) or completion, all for high accuracy. The fact of working at large water depths and having the tools at the end of the string (BOP's, packers, wellheads, connectors, Christmas trees, etc.) turn the operations of casing running, connection, coupling, etc., into tasks rather difficult to be conducted with the required accuracy. Considering the fact that all wells are concentrated within one single "box", it is easy to understand the risk of shock between equipment units which is faced when installing a BOP or a Christmas tree (heavy, large equipment) where other wells already drilled or completed exist.

The English publication GB 2003533A, of Mar. 14, 1979, (corresponding to U.S. Pat. No. 4,126,008) describes a structure designed with the purpose of solving the problems of weight, transportation and installation above described. It is a floating template which comprises a central structure, out of which arms extend which fold onto the central structure during the transportation; at the extremity of each arm a conventional template is located, and the central structure can be used as a template as well. The structure is set at the seabottom by means of controlled flooding of the piping which constitutes the structure.

As it may be verified, the problem of spacing between wells and operation safety were not solved.

The French publication FR 2449775, of Sept. 19, 1980 (corresponding to U.S. Pat. No. 4,211,281), describes a subsea production system in which a number of individual (satellite) wells, drilled in different locations in the field, have their production gathered into a production collecting device, installed at the seabottom in a position within the wells; individual well production is taken to a manifold installed in a submersible platform by means of export lines, which are put together in the shape of a bundle of lines rising from the seabottom to said platform; the crude oil returns to the seabottom through a pipeline inside the bundle, being thereafter taken up to a pivoting buoy, for purposes of loading the tankers.

Connection between the producing wells and the central production collecting device is achieved by means of connection lines supported by elongated, articulated structures, supported at the seabottom and which converge into a central point which shall serve as the base for said production collecting device. Thus, the elongated structures which support those connection lines have, in one of the extremities, a guide for the well to be drilled and, in the other extremity, a central base face which supports the production collecting device.

The system described in the French publication mentioned above solves partially some of the problems which were pointed out, but the operational difficulties, particularly those relating to connection point alignment and tool connection, remain unsolved, since the problems arising from seabed irregularities were not taken into account.

SUMMARY OF THE INVENTION

One purpose of this invention is to provide a subsea production system which includes a subsea template structure, for utilization in very deep waters, which must be light and offer higher operational flexibility.

Another purpose of this invention is to provide a structure which is simpler, more economical and does not suffer major setting limitations due to seabottom irregularities.

Another purpose of this invention is to provide a subsea production system including a template structure which allows for a larger spacing between wells, thus increasing safety in operational work and reducing tool impact risks at the time of setting it.

Another purpose of this invention is to provide a subsea production system, with a structure for oil well drilling and completion which allows for the utilization of remote-operated vehicles (ROV's) during the operations in which their use is required.

Those purpose and the advantages of the invention shall become more evident, as well as the technical solution found to achieve them, as it is described.

According to this invention a new concept of subsea structure for oil well drilling, completion and production is presented, said structure having been specially designed for utilization in water depths of 1,000 m or more.

Said structure includes a template manifold which extends radially from central foundation, on top of which said structure shall be set, so as to remain apart from the seabed, and on top of which the central manifold for well production control is installed; each structure arm has in its extremity an opening for guide-base adaptation, with the purpose of allowing for well drilling and Structure attachment, one of the structure arms being intended to receive the connectors of the export and well control lines

DETAILED DESCRIPTION OF THE INVENTION

As previously described, one of the difficulties faced in the phase of subsea well drilling relates to the deposition of cuttings within the template structure and onto the image-taking points, thus preventing operations monitoring by means of TV sets installed at the surface.

The subsea structure, the object of this invention, being a more transparent and more elevated structure, prevents the accumulation of cutting within it, since the return points of well drilling cuttings are located below the structure level.

From an economic point of view, the structure offers some advantages which become immediately evident. Being a lighter structure, it is less expensive since it requires less raw material and does not call for the utilization of a major crane for its installation. Not requiring a more accurate levelling system, its foundation can be simpler, which makes it less expensive as well.

Figure 1:
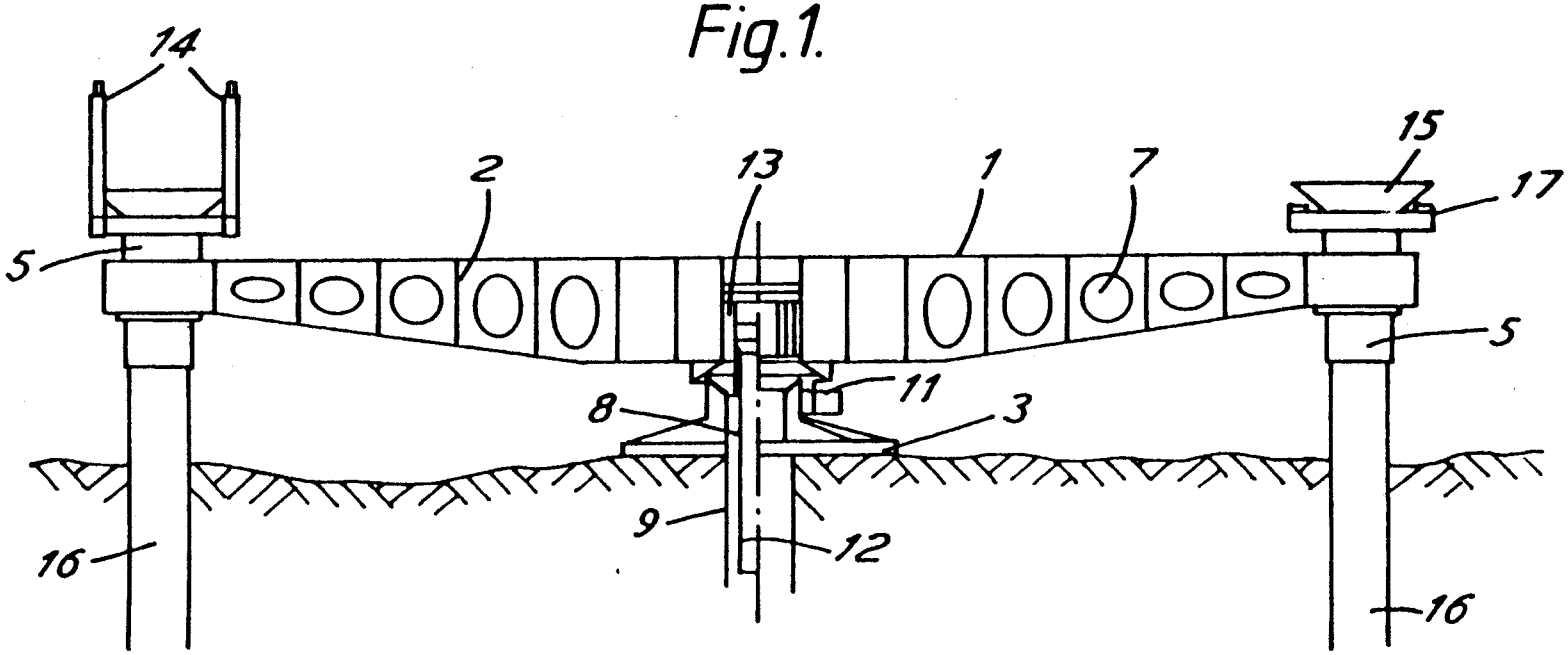
FIG. 1 represents a side view, partially in section, of the subsea structure included in the subsea production system of the invention, set onto the central foundation.
Figure 2:
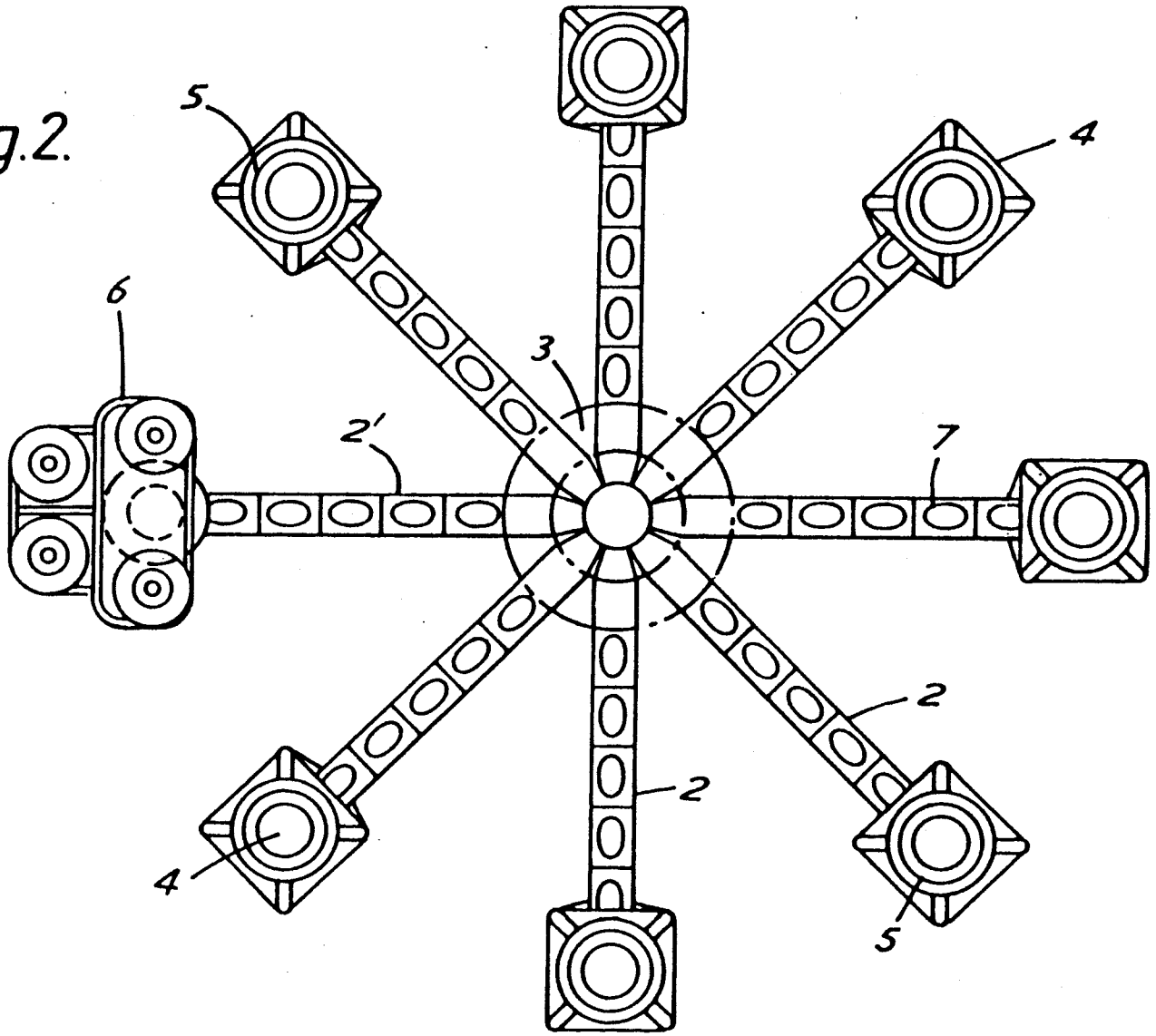
FIG. 2 shows an overview of the structure, in which are represented eight guide-bases at the extremities of its arms, seven arms for the subsea wells and one for the installation of connectors of the export and control lines.

As can be seen of in FIGS. 1 and 2, the subsea structure includes a template (1) with arms (2) extending radially from a central foundation (3), on top of which said template (1) and the central control manifold (31) (not shown on these figures) are set. At the extremity of each arm (2), except one arm (2'), of the template (1) an opening (4) is located, for accommodating a well guide (5) intended for well drilling.

In FIG. 2 appears a structure with eight arms, out of which seven (2) are intended for well drilling, whereas one (2') is reserved to receive at its extremity (6) the connectors (29) of the export and well control lines (30). However, neither the construction of the arms (2) with box-type beams, as represented in the figures, nor the number of arms, are limiting factors of the invention.

The structure can be adapted for as many arms as desired, observing only the general template design which reserves one of the structure arms for the installation of connectors (29) and joins them to the central control manifold (31).

The void spaces (7) which appear in the structure are intended to reduce its weight, usually large in box-type beams, as well as make the structure more transparent.

One advantage of the structure of the invention is that, for its installation, only conventional tools and techniques are utilized, which are widely known to the experts in the subject.

Thus, returning to FIG. 1, the central foundation (3) is assembled based on well-known elements. A temporary base (8) is set at the seabed together with a pile (9) through a jetting technique, which is maintained rigidly attached to said base (8) by means of a housing, welded to said pile (9) and blocked by means of bolts.

Figure 3:
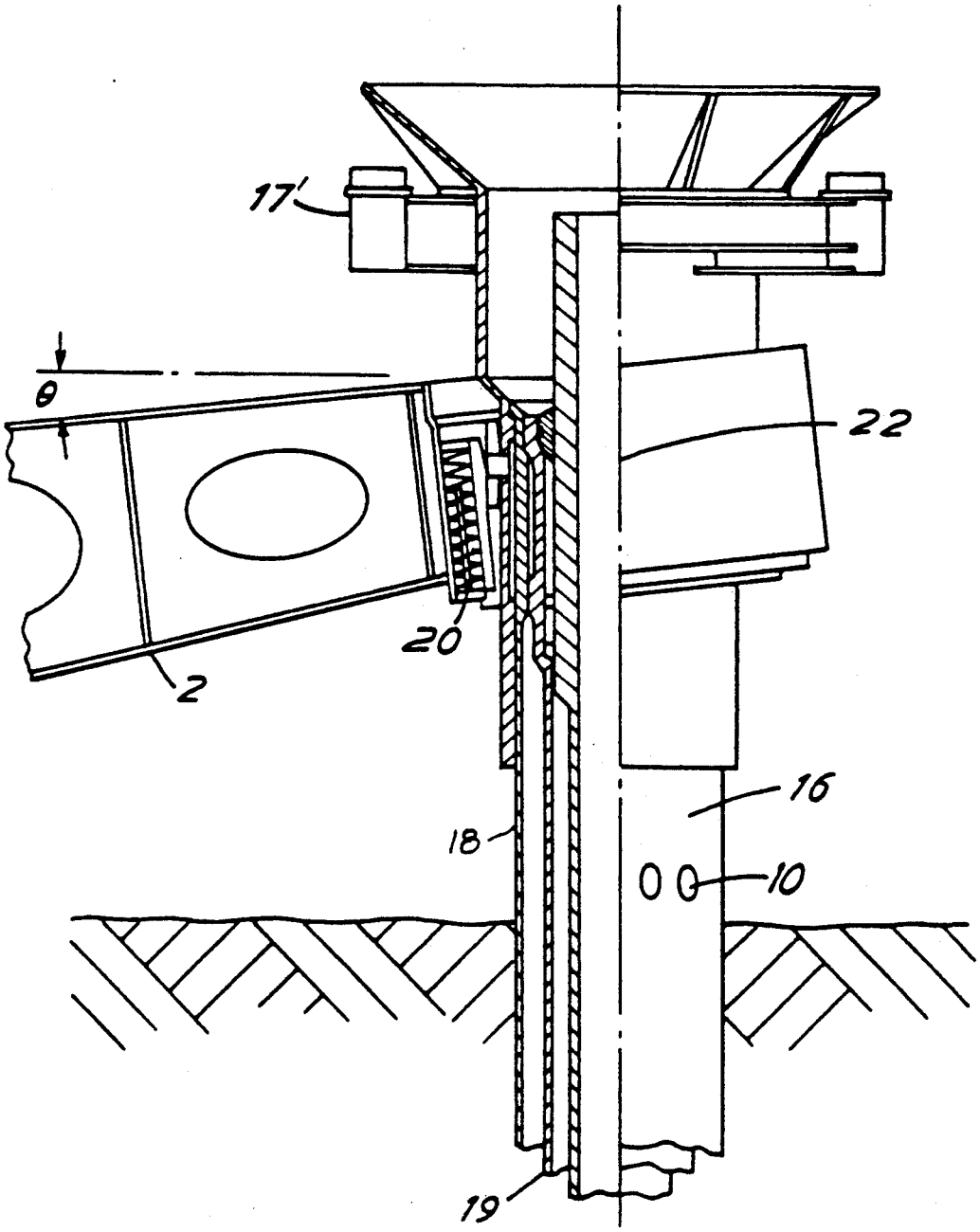
FIG. 3 represents a side view, partially in section, of a subsea well with its guide, in which the relative movement between the well guide and the template structure of the invention is shown.

The whole installation operation of the central foundation (3) is monitored at the surface by means of a TV circuit, so as to ensure appropriate levelling conditions. For that purpose, a level-indicating instrument (11) is located at said temporary base (8) well above the cuttings outlet and return orifices (10) as shown in FIG. 3, thus preventing cuttings deposition onto the level indicator (11).

The maximum inclination allowed in relation to the vertical is 2 degrees, since it is limited to the play allowed for tool connection, at the time of well drilling and completion.

Similarly, to the technique utilized in oil well drilling, a conductor pipe (12) is run inside the pile (9), cemented and set by means of another housing, on top of which a second base (13) shall be installed for purposes of template (1) setting. With this elevation of the template (1) structure, the problem of cuttings deposition within it is solved as well.

The fact of the structure (1) being maintained in an elevated position in relation to the seabed, set onto the central foundation (3) only, and, as it shall be seen later on, supported by the well guides (5) in each arm (2) extremity, ensures that cuttings deposition shall occur around the wells, not preventing the monitoring of the operations at the surface.

Another advantage of the subsea structure of the invention is that it does not limit the drilling, completion or production operations to one single technique. For instance, well drilling can be conducted utilizing both a guide-base provided with guide-posts and guide-cables (14) and guide-bases provided with guide-funnels (15), depending upon the type of rig which is available.

However, whichever the choice, the extremities of the arms (2) of the template structure are provided with guides (5) for the wells (16), all of them provided with housings (17) for remote post connection, in case it is desired to change the system, in the production phase for instance, and also to serve as a support for the installation of flowline connectors, as shall be described later on.

In the arm (2') reserved for the installation of connectors (29) for the export and well control lines, the well guide (5) is utilized to install a foundation for structure (1) support.

In FIG. 3 appears one of the extremities on an arm (2) of the template, through which a well (16) is being drilled. The wells are drilled through the guides (5), according to conventional techniques, following the standard operational sequence up to wellhead installation.

One relevant aspect of the invention relates to the supporting system (22) of the guide (5) of the well at the template structure (1).

The pile (18) and the surface casing (19) are dimensioned with the purpose of withstanding most stresses which occur at the wellhead, being minimal the amount of said stresses transferred to the template structure (1) and, consequently, to the central foundation (3). This result is achieved by means of a spring system (20), shown in detail on FIG. 4, located at the interface of the well guide (5) of the well with the template structure (1). This spring system (20) makes it possible to monitor those mentioned stresses through visual inspection on a TV system, correlating the deflection suffered by the system (20) to the displacement verified in a graded rod, inserted in said spring system.

The invention also provides for a knuckle-joint supporting system, which allows for considerable variations between the inclinations of the well (16) and of the template (1), that is, it makes it possible to drill the well within inclinations admissible for tool connection, regardless of the template structure inclination.

In practice a maximum inclination $\theta$ limit was adopted in the order of 6 degrees, considered sufficient to compensate for the operational difficulties of drilling a perfectly vertical well. Such deflection shall be due both to the inclination $\theta$ of the template and to that of the well. However, values in excess of 6° can be easily achieved with the correct positioning of elements restricting the knuckle-joint movement.

Such characteristic is not present in the templates so far known and ensures the operational flexibility and safety pointed out as purposes of the subsea structure of the invention, making it highly advantageous in relation to the structure so far known for this purpose.

Figure 4A:
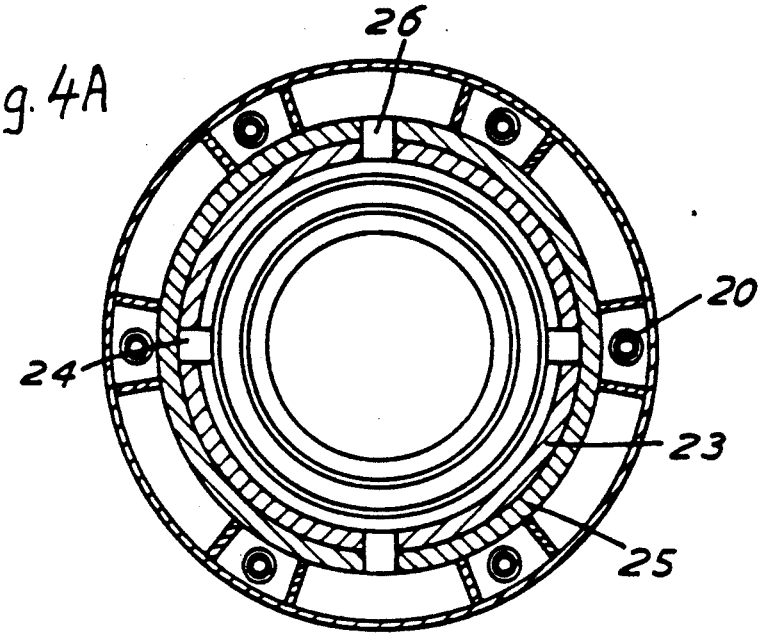
FIG. 4A is a cross-sectional view taken along line A—A of FIG. 4.
Figure 4:
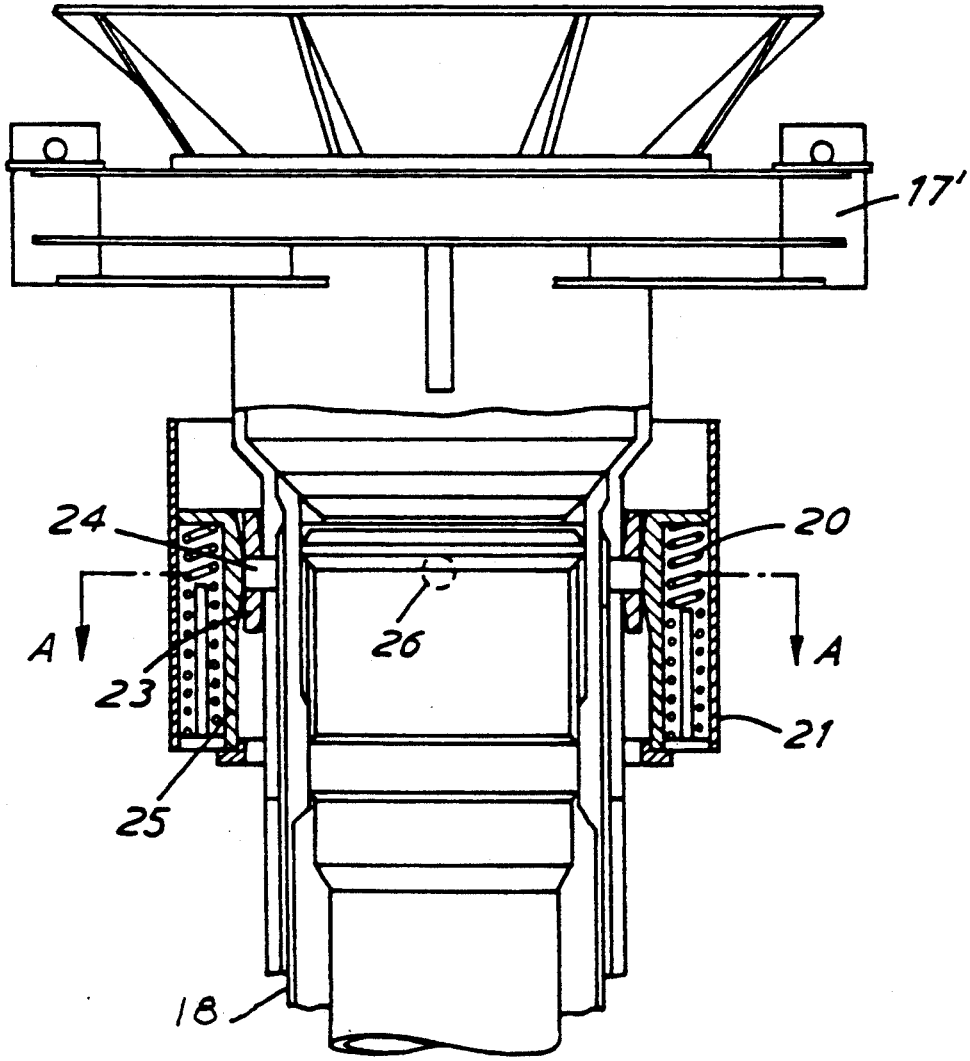
FIG. 4 shows in detail the supporting system of the well guide.

FIG. 4 shows in detail the spring system (20) and the well guide support (22). Once the pile (18) is set, it is blocked to the guide (5) of the well by means of an internal ring (23) thereto attached by means of two pins (24), which are aligned according to the longitudinal axis of the arm (2) of the template structure (1). Thus, the movement of the guide (5) of the well around this longitudinal axis shall be free, whether through the application of roller bearings to said pins (24), or through the utilization of a ring (23), in which the housing of the pins is larger than their diameter.

The internal ring (23) transfers the stress to the template structure (1) by means of a second ring (25) crossed by two other pins (26), located in the same plane of the two pins (24) referred to above, and aligned according to an axis perpendicular to the longitudinal axis of the arm (2) of the structure (1), allowing for the rotation of the set also around this other direction. As a consequence, combining the movement around those two axes, it is possible to verticalize the wellhead, regardless of the inclination $\theta$ prevailing at the structure (1), said inclination $\theta$ being maintained within the specified limits by means of the knuckle-joint supporting system (22).

Although the possibility of a relative movement between the well guide (5) and the structure of the template (1) offers a major advantage, it also poses some difficulties concerning the guarantee of the tolerances required for the perfect connection of the Christmas trees to be installed during the well completion phase. This problem can be easily overcome through the installation of the flowline connectors (29') of the wells at the same level of the guide (5) of the well, where the housings (17) for remote post connection are located. This embodiment shall become clearer through the observation of FIG. 5.

Figure 5:
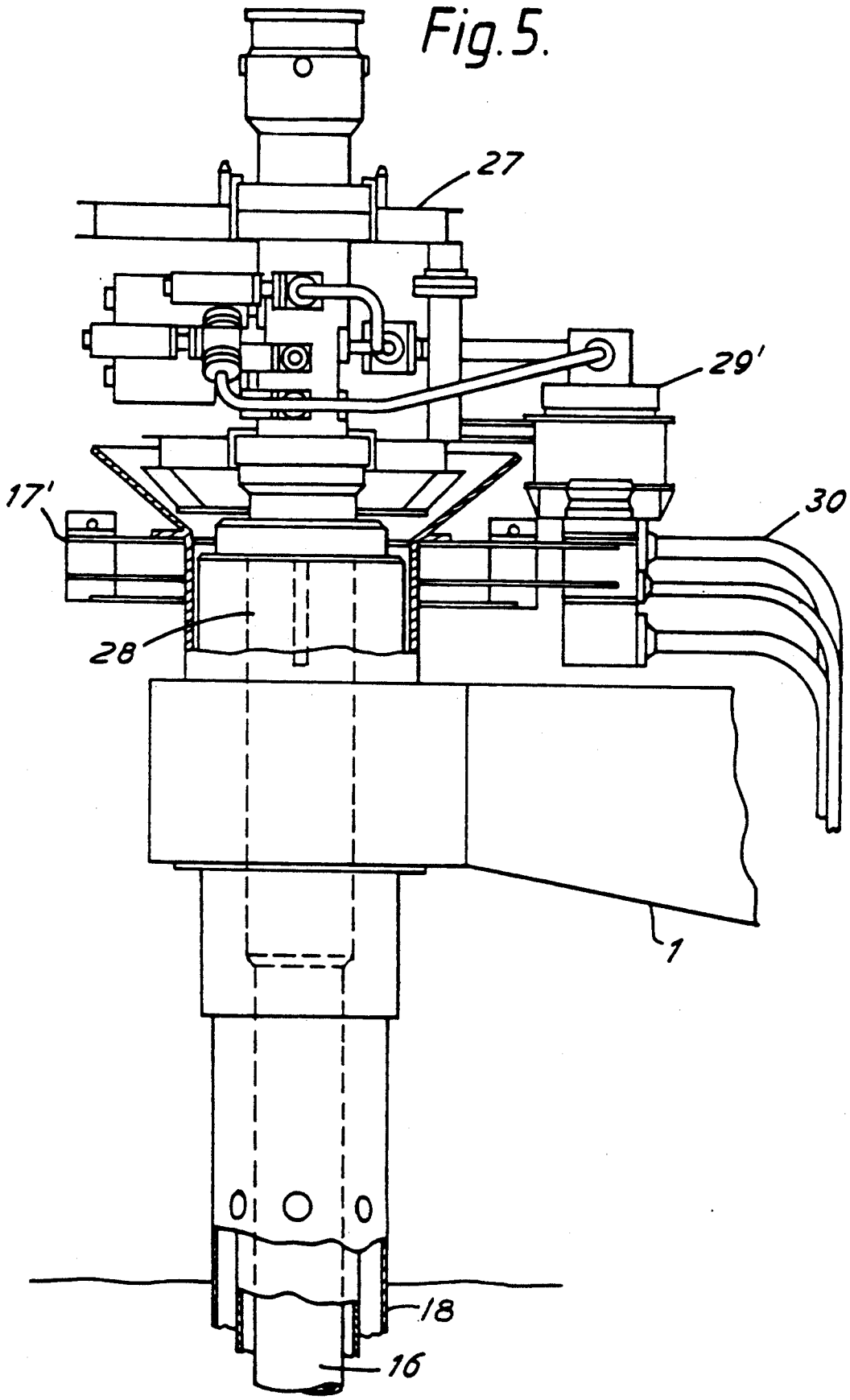
FIG. 5 represents a side view in section of a well located in one of the structure extremities, in which the Christmas tree and the respective connections and transfer lines have been already installed.

FIG. 5 shows an extremity of the template structure (1) in which a well has been drilled and completed, and the connections have been made.

As the Christmas tree (27) is lowered in the well (16), it must be simultaneously attached to the high-pressure housing (28), from where it shall receive the oil produced, and to the flowline connector (29') of the tree (27), through which it shall send the oil produced to the central manifold (31), by means of lines (30) specially dimensioned for this purpose. The central manifold is shown in FIG. 6, which is described later on.

The flowline connector (29') being located in the same level where the slots (17') for guide-post installation are located, the movement of the flowline shall be identical to that of the guide (5) for the well, since both parts became rigidly attached. Thus, the relative position between the connection points of the Christmas tree (27) becomes perfectly controlled, since the inclination of the well guide (5) of the well is controlled by the inclination of the well (16) itself.

The freedom of movement conferred to the flowline connector (29') of the Christmas tree (27) in relation to the template structure (1) is easily absorbed by the transfer lines (30), which are long enough to admit strains which compensate for variations in the relative positioning of the parts.

Figure 6:
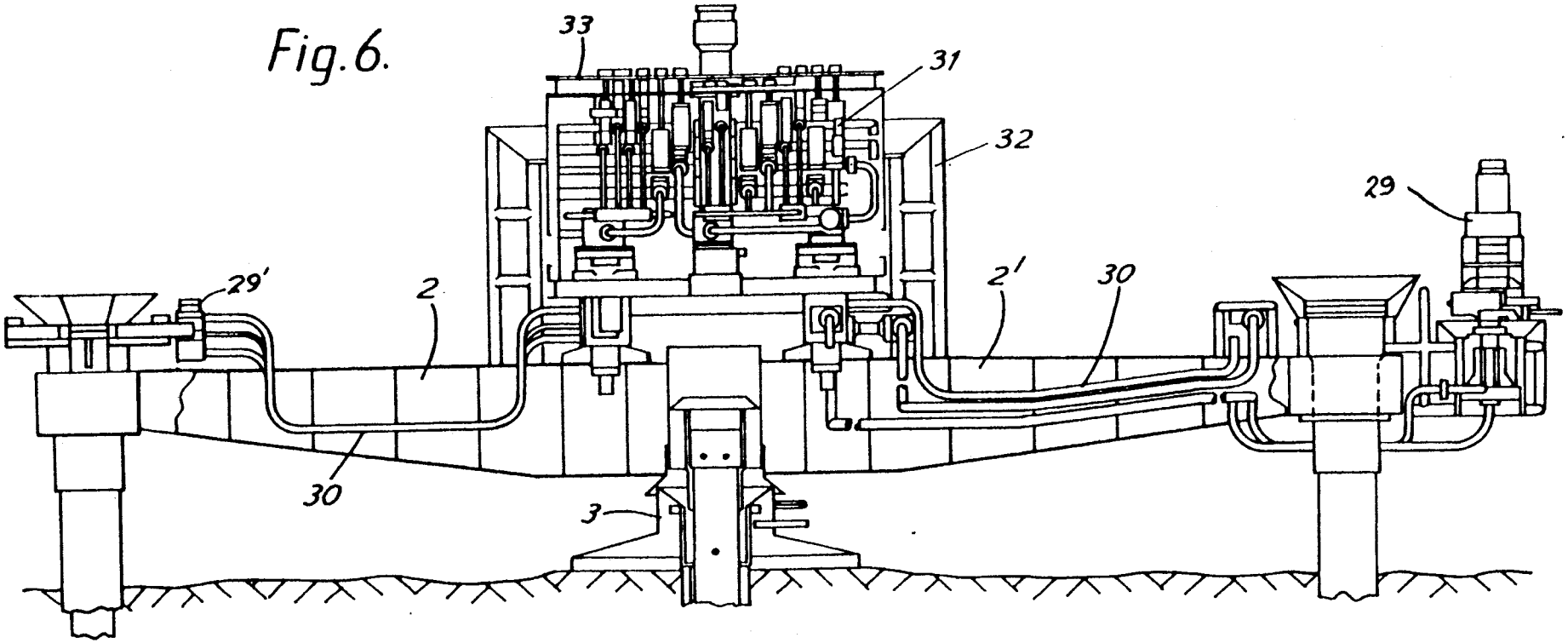
FIG. 6 represents a side view of the central production control manifold, already installed at the template.

FIG. 6 shows in detail the central manifold (31) which, although it is installed jointly with the template structure (1), presents the characteristic of being removable.

The possibility of removing the central manifold (31) represents a major advantage of the invention, since, in case of casual accidents and/or equipment defects, the repairs can be more easily performed.

Since the central manifold is located at equal distance from the wells, for higher system safety, it is surrounded by a protection screen (32) and presents in its upper portion a fenced platform (33), which covers the central manifold (31) and allows for remote operation vehicles setting, making easy valve identification and also the access for minor repairs.

A form of reducing the failures due to manifold malfunctioning, and which has been adopted in this invention, consists in concentrating the active flow elements (valves and chokes) in the Christmas trees (27), leaving to the central manifold (31) only passive elements as, for instance, piping, some valves of occasional operation, which can be driven by means of remote-operation vehicles, etc.

The configuration of the central manifold (31) may vary according to its purpose, assuming different geometries and functions, in accordance with the purpose to be achieved. The manifold illustrated on FIG. 6 has been dimensioned for seven wells' control. The export and control connectors (29) are installed at the extremity (6) of one (2') of the arms of the template structure (1), as previously mentioned. The number of connectors (29) required is determined so as to meet the particular characteristics of the exploitation project of a given oil field, and each connector can work with more than one line.

Although the above description has been based on a embodiment illustrated by the figures, it is possible to introduce modifications, often evident to the skilled in the art and which have not been commented herein, without deviating from the spirit of the invention. Thus, the figures which are included in this specification have a purely illustrative character, not limiting howsoever the invention.

What is claimed is:

1. Production system for a plurality of subsea oil wells drilled in a seabed located in deep waters having a depth of at least 1000 meters which includes a subsea structure for drilling and producing said wells, said structure comprising a template (1) having a plurality of arms (2, 2') extending radially from a central foundation (3) which extends above the seabed, on top of which said template (1)' is set so as to maintain it spaced above the seabed, and on top of which a central production control manifold (31) for the oil wells is removably mounted; each arm (2) of the template (1), except one arm (2'), being provided in its free extremity with an opening for accommodating a well guide (5) which allows for the attachment of a well (16), only said one arm (2') being adapted to receive in its free extremity an opening for accommodating a well guide (5), for arm support purposes, and also flow-line connectors (29) of export and well control lines (30);

wherein in each said free extremity there is a spring system (20) with a knuckle-joint supporting system (22) for supporting the well guide (5) and transferring the stresses which occur at the wellhead to the central foundation (3) of the template (1);

wherein said knuckle-joint supporting system (22) also has the function of making it possible to drill the well within an admissible inclination for tool connection, regardless of the inclination of the template (1) to the horizontal;

wherein said knuckle-joint supporting system (22) allows for template inclinations on the order of 6 degrees; and further comprising well flow-line connectors (29') installed in the template (1) on, and at the same level as that of, each well guide (5) used for well production, so that the relative position between points of connection to a Christmas tree (27) in each well (16) is maintained.

2. Production system according to claim 1 wherein said supporting system (22) supports each well guide (5) to permit rotation thereof around both a first axis alined with a longitudinal axis of an arm and also a second axis perpendicular to said first axis.

* * * * *